US006457909B1

(12) United States Patent
Xu et al.

(10) Patent No.: US 6,457,909 B1
(45) Date of Patent: Oct. 1, 2002

(54) MULTI-PURPOSE ANCHOR BOLT ASSEMBLY

(76) Inventors: Shulin Xu, Via Giaccomo Bove 3, Torino, 10129 (IT); Ashraf Mahtab, 270 Sandy Cove Road, Sandy Cove, NS B0V 1E0 (CA)

( * ) Notice: Subject to any disclaimer, the term of this patent is extended or adjusted under 35 U.S.C. 154(b) by 0 days.

(21) Appl. No.: 09/741,913

(22) Filed: Dec. 22, 2000

(51) Int. Cl.[7] ..... E21D 20/00

(52) U.S. Cl. ..... 405/259.1; 405/302.1; 175/388; 175/386

(58) Field of Search ..... 405/259.1, 259.5, 405/259.6, 259.2, 259.3, 259.4, 302.1; 175/385, 386

(56) References Cited

U.S. PATENT DOCUMENTS 3,311,012 A * 3/1967 Williams ..... 405/259.5
4,194,858 A 3/1980 Evans
4,576,524 A * 3/1986 Heintzmann et al. .... 405/259.5
4,649,729 A * 3/1987 McDowell et al. ..... 405/259.5
4,911,583 A 3/1990 Carey
5,018,908 A 5/1991 Laphon
5,114,278 A * 5/1992 Locotos et al. ..... 405/259.1
5,392,869 A 2/1995 Froschl et al.
5,599,140 A 2/1997 Wright
5,622,454 A 4/1997 Ashmore et al.
5,628,587 A * 5/1997 Lesslie ..... 405/302.1
5,649,789 A 7/1997 Denz
5,885,031 A 3/1999 White
5,899,640 A * 5/1999 Yeh ..... 405/259.1
5,934,840 A 8/1999 Nicholson

* cited by examiner

*Primary Examiner*—Heather Shackelford
*Assistant Examiner*—Frederick L. Lagman
(74) *Attorney, Agent, or Firm*—John P. McGonagle

(57) ABSTRACT

A multi-purpose anchor bolt, which performs two principle functions: (1) it acts as an active reinforcement for the ground when it is installed and tensioned, and (2) it is used to excavate and advance the face in steps. The invention also includes the method of the multi-purpose anchor bolt's use. This invention is a hybrid of traditional and mechanized excavation techniques.

12 Claims, 7 Drawing Sheets

MULTI-PURPOSE ANCHOR BOLT ASSEMBLY

BACKGROUND OF THE INVENTION

This invention relates to anchor bolts used in ground excavation, and in particular, to an anchor bolt assembly for simultaneous support and excavation of weak ground.

When an excavation is made in weak ground, i.e., ground that cannot support itself for a reasonable period of time and for a reasonable size of excavation, stabilizing the excavation face, i.e., the front of the advancing excavation, becomes necessary. This is true for both surface and underground excavations.

The current practice addressing the problem of face stability may be discussed with reference to the two principal excavation approaches, i.e., conventional excavation and mechanized excavation.

In the conventional excavational approach, the following techniques are used:

(a) The entire face is divided into a number of smaller, self-supporting (or self-supporting with the assistance of a layer of sprayed concrete) faces for step-wise excavation (one smaller face at each step), and the excavation is advanced to a pre-determined location of the face. See FIGS. 1A and 1B where reference numerals 1 through 9 represent the smaller faces and 12 represents the entire face. FIG. 1A illustrates the initial excavation sequence with primary support. FIG. 1B represents the final sequence with final lining. The example shown in FIGS. 1A and 1B is for an approximate twenty-seven meter wide tunnel having a height of approximately eighteen meters. The principal shortcomings of this technique are that the advance is slow and there is an added expense of supporting the smaller faces and their peripheries.

(b) The face is pre-supported by using the technique of "forepoling" which comprises the installation of grouted anchors 10 (or dowels) normal to the face. See FIG. 2, illustrating a forepoled tunnel in coal, said tunnel having a roof 11, face 12, boreholes 13, seam 14, and resin 15 about the dowels 10. In the case of an underground excavation, the forepoles 10 are often installed at an upward-inclined angle at the crown of the opening. The disadvantages of this technique are that extra time is involved for the grout to harden; there is only the one-time use of the dowels; the hole for the dowel may be unstable; and the dowel only provides a "passive" reinforcement (or stabilizing force). The passive reinforcement results from the outward (toward the excavated space) deformation of the ground which, in turn, is resisted by the dowel, thus producing tension in the dowel and, as a reaction, producing confinement (or stabilizing force) to the face. In contrast, the "active" reinforcement is achieved by pre-tensioning the dowel (or bolt), which restricts the outward deformation of the ground.

(c) The face is supported by modifying the characteristics of the ground by means of jet grouting. This technique creates grouted columns (horizontally) which help to stabilize the face. The disadvantages of this technique are that: specialized equipment is needed, an exceptionally large amount of time is required for the operation, and the cost of the technique increases with depth because the jet grouting equipment has to be removed after each advance of the face.

In the mechanized excavation approach, a tunnel boring machine (TBM), normally a shielded TBM, is used. The following techniques are used for supporting the face:

(a) A physical shield is used to protect the workers and the equipment while the face is stabilized with compressed air or by ground freezing.

(b) A slurry or earth-pressure balance support is used at the face, ahead of the cutter head of the TBM.

The disadvantages of this technique include the questionable reliability of the technique, safety aspects, and slow advance of the excavation face. Furthermore, there is a large initial investment, inflexibility with regard to alignment of (tunnel) excavation, huge and expensive back-up system, and requirement of very skilled labor.

SUMMARY OF THE INVENTION

In view of the foregoing disadvantages inherent in the known types of devices now present in the prior art, the present invention provides both passive and active reinforcement, thus making it possible to control the outward deformation of the face, which is the critical aspect of ground control in design of excavations of weak ground.

The main objectives of the invention are to: provide continuous support and reinforcement to the front (or face) of an advancing excavation in weak ground; advance the face at a higher rate compared to the results of the current methods by performing simultaneous reinforcement and excavation; reduce the cost of advancing the excavation by eliminating the need for renewed reinforcement of the face after each advance; improve the reliability of the face reinforcement and, consequently, the safety of the workers; and eliminate the constraint of not exceeding a threshold for the radius of curvature of the tunnel axis, as in the case of excavating by a TBM.

To attain this, the present invention provides a multipurpose anchor bolt, which performs two principal functions: (1) it acts as an active reinforcement for the ground when it is installed and tensioned, and (2) it is used to excavate and advance the face in steps. The invention helps to advance the face at a higher rate compared to the results of the current methods by performing simultaneous reinforcement and excavation functions. The invention reduces the cost of advancing the excavation by eliminating the need for installing new reinforcement at the face after each advance. The invention is a hybrid of traditional and mechanized (such as a full-faced TBM) excavation techniques.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be made to the accompanying drawings and descriptive matter in which there is illustrated a preferred embodiment of the invention.

DETAILED DESCRIPTION OF THE INVENTION

Figure 1A:
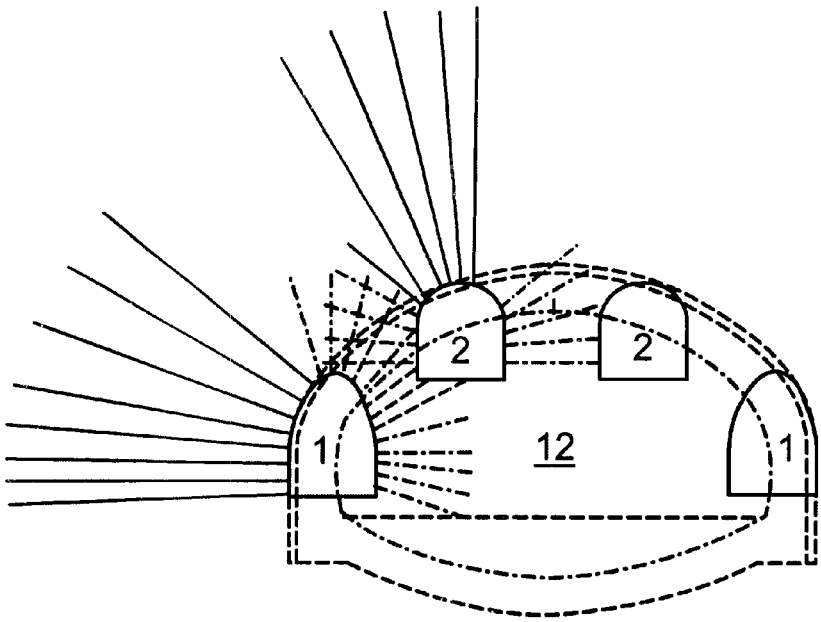
FIG. 1A illustrates the initial excavation sequence with primary support for step-wise excavation and support of a tunnel in weak ground.
Figure 1B:
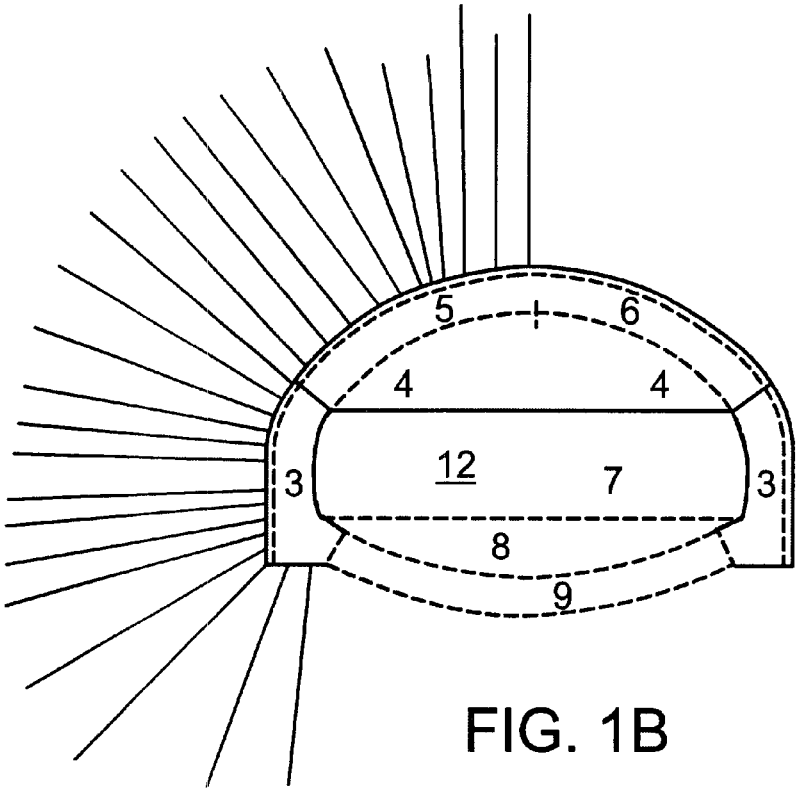
FIG. 1B illustrates the final excavation sequence with final lining for step-wise excavation and support of a tunnel in weak ground.
Figure 2:
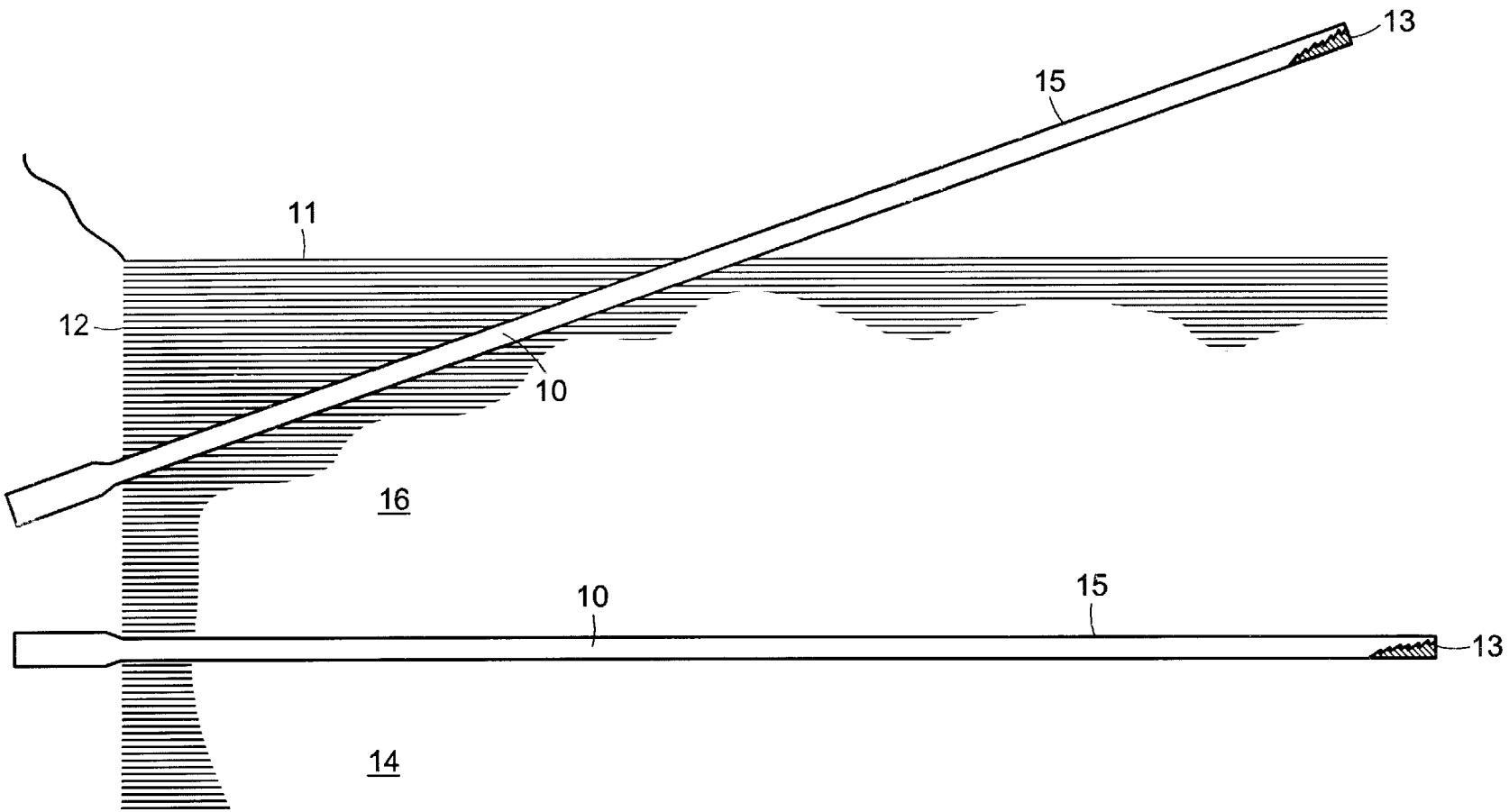
FIG. 2 illustrates forepoling in coal using dowels.

Referring to the drawings in detail wherein like elements are indicated by like numerals, there is shown, especially in FIGS. 3–5C, and 7, a multi-purpose anchor bolt assembly 19 comprised of an elongated anchoring element 20, a bearing plate 50 attachable to said anchoring element 20, and an excavation head 60 attachable to said anchoring element 20.

The anchoring element 20 is an elongated, generally cylindrical element with a variable diameter. The anchoring element 20 has a forward end 21 terminating in a conical tip 22, sometimes terminated "head", and a rearward end 23. The longitudinal axis of the anchoring element 20 is defined by the forward end 21 and the rearward end 23. The anchoring element 20 has an internal, central, longitudinal aperture 24 along its central longitudinal axis. The anchoring element 20 may be divided longitudinally into three main portions, a forward portion 25, a middle portion 30, and a rearward portion 40.

The forward portion 25 begins at the anchoring element forward end 21 and extends rearwardly toward the rearward end 23 a predetermined distance. The forward portion 25 comprises a tapered anchoring screw having a diameter increasing from a minimum diameter at the anchoring element forward end 21 to a maximum diameter at the tapered anchoring screw rearmost end 26. The forward portion 25 has a helical external surface 27 suggesting a screw thread. The forward portion 25 has a plurality of radial holes 28 extending from the external surface 27 and opening into the anchoring element central aperture 24.

The middle portion 30 extends rearwardly along the anchoring element longitudinal axis from the forward portion rearmost end 26 a predetermined distance toward the anchoring element rearward end 23. The middle portion 30 comprises a drill bit which facilitates the reach of the tapered anchoring screw 25 a desired depth. The middle portion 30 has an external surface 31 shaped with cutting drill teeth 32. The middle portion 30 terminates rearwardly in a gradually increasing, tapered, radial, flange-like, plate element 33. The middle portion flange plate 33 has a tapered front surface 34 and a flat rear surface 35. The flange plate front surface 34 faces the anchoring element forward end 21 and the flange plate rear surface 35 faces the anchoring element rearward end 23. The flange plate 33 provides a means for drilling as well as providing confinement to the material expelled by the drill bit 30. In this embodiment of the invention the flange plate rear surface has four key holes 36 formed therein. Other embodiments may have more or less key holes. The key holes 36 accommodate bearing plate keys and excavation head keys as are discussed below.

The rearward portion 40 extends rearwardly along the anchoring element longitudinal axis from the flange plate rear surface 35 to and terminating at the anchoring element rearward end 23. The rearward portion 40 comprises a bearing plate 50 and excavation head 60 anchoring element engagement portion as described in more detail below. The rearward portion 40 may be divided along the anchoring element longitudinal axis into two segments, a forward segment 41 and a rearward segment 42. The forward segment 41 begins at the middle portion flange plate rear surface 35 and extends toward the anchoring element rearward end 23 a predetermined distance. The forward segment 41 has a smooth external surface 43 and a diameter less than the diameter of the drill bit 30. The rearward segment 42 begins where the forward segment 41 rearwardly ends and extends to the anchoring element rearward end 23. The rearward segment 42 has a threaded external surface 44 and a diameter approximately equal to the diameter of the forward segment 41.

Figure 3:
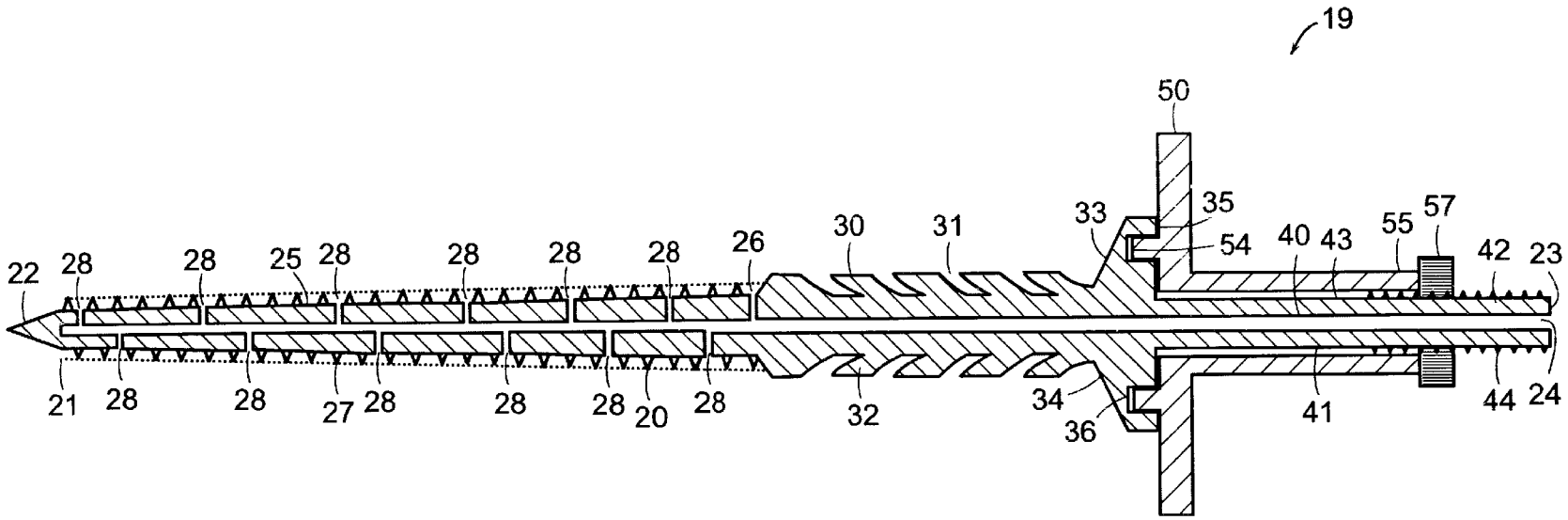
FIG. 3 is a longitudinal section view of the invention.
Figure 4C:
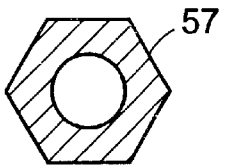
FIG. 4C is a view along the line 91—91 of FIG. 4B.
Figure 4B:
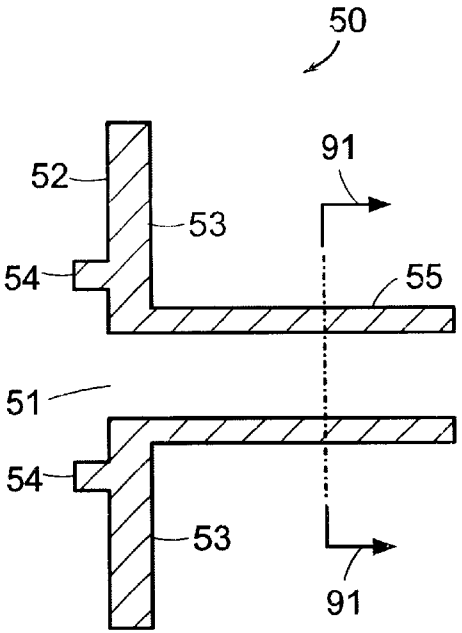
FIG. 4B is a cross-sectional view along the line 90—90 of FIG. 4A.
Figure 4A:
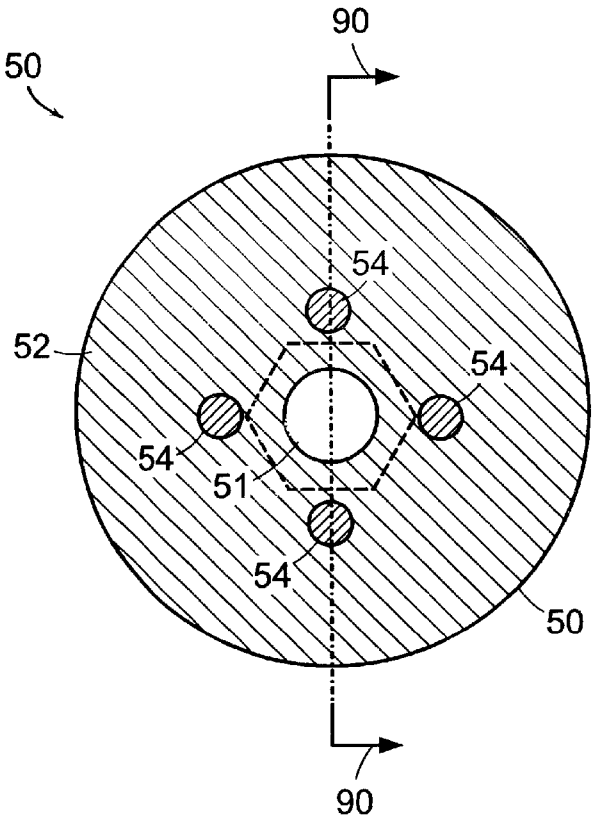
FIG. 4A is an end view the invention bearing plate.
Figure 6:
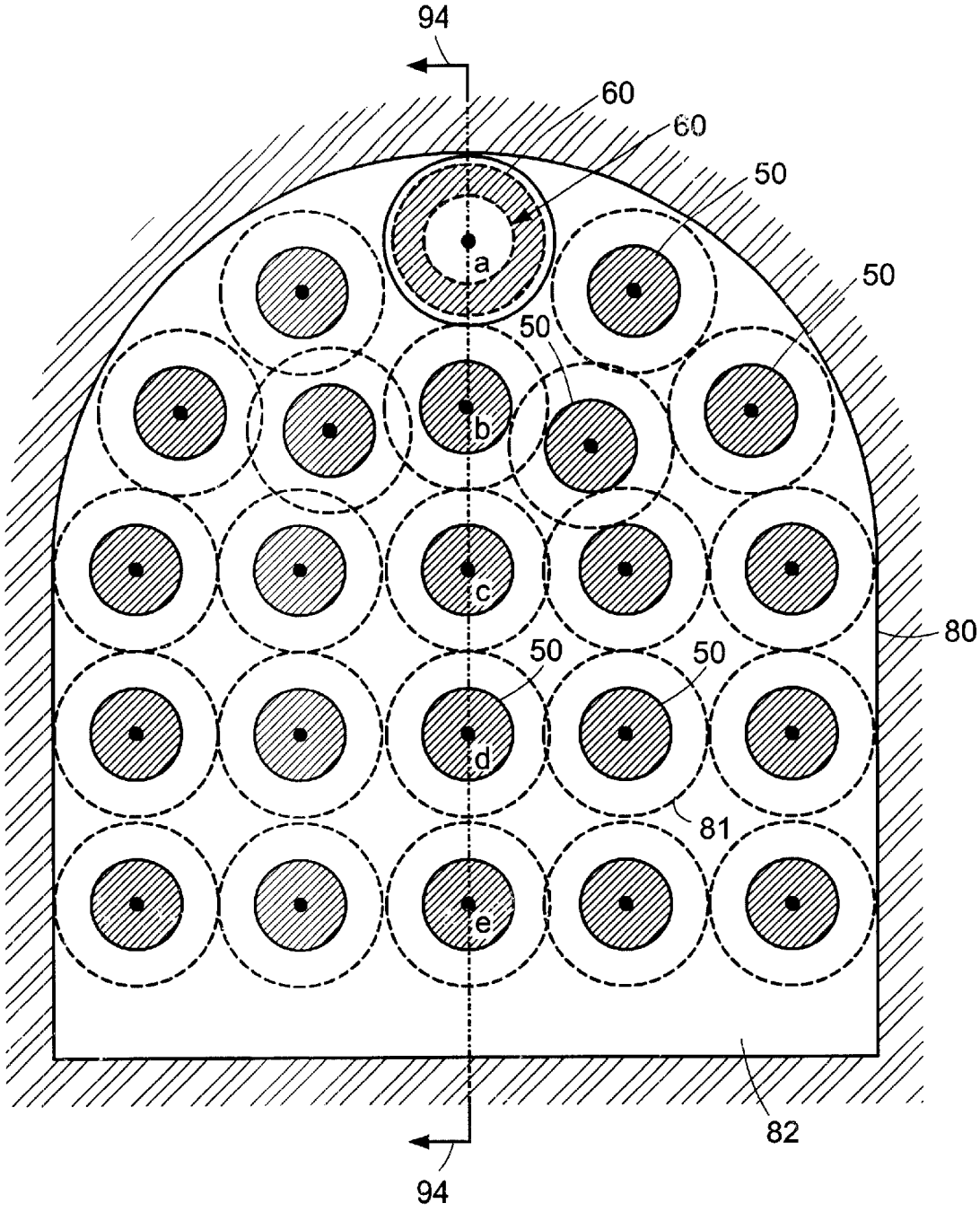
FIG. 6 illustrates a typical application of the invention to tunneling.
Figure 7:
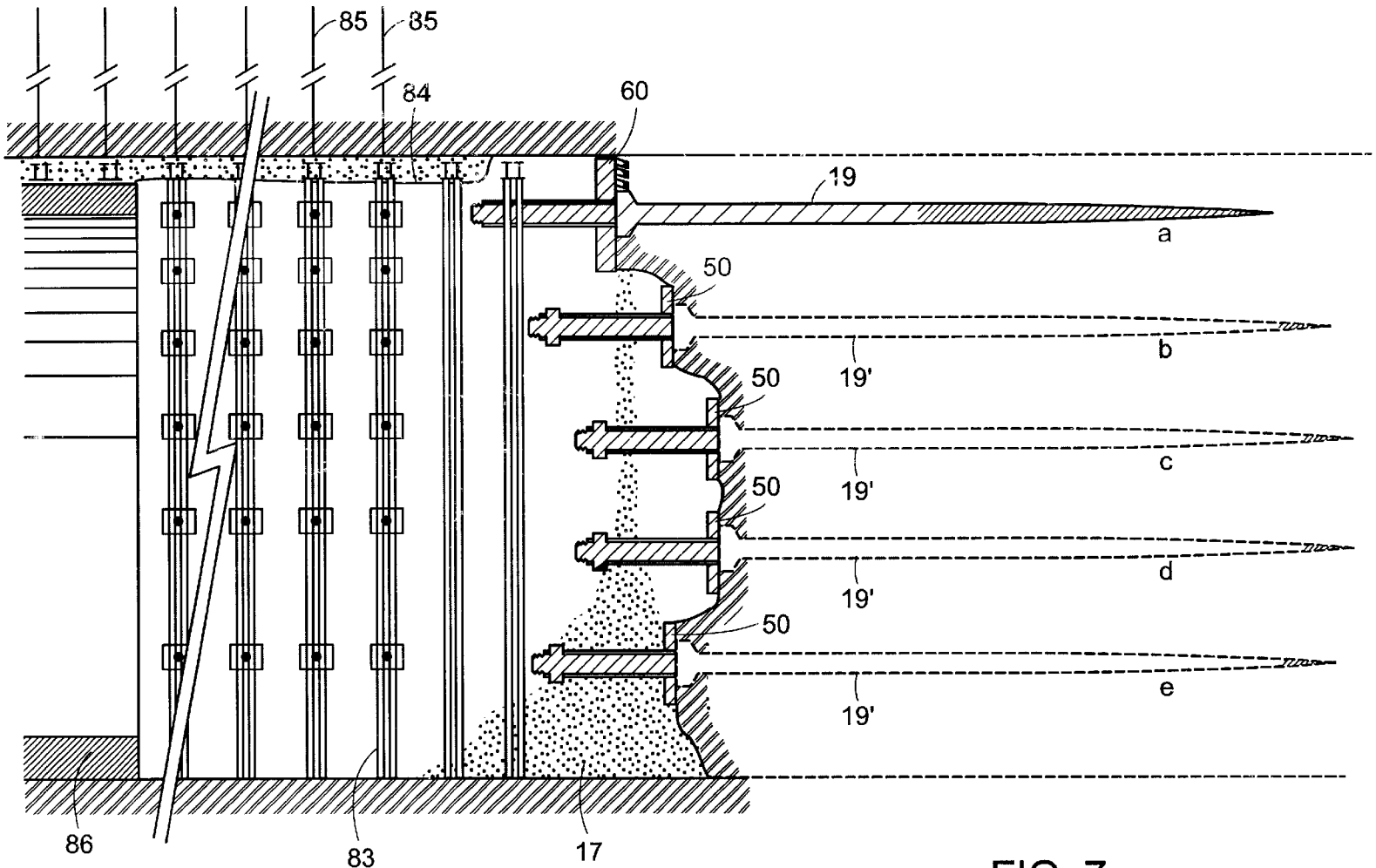
FIG. 7 is a longitudinal sectional view along the center line 94—94 in FIG. 6.

Referring more particularly to FIGS. 4*a* and 4*b*, as well as FIGS. 3, 6 and 7, the invention is further comprised of a bearing plate 50 attachable to said anchoring element 20. The bearing plate 50 is a round, plate-like element with a diameter several times greater than the diameter of the anchoring element, middle portion, flange plate 33. The bearing plate 50 has a central hole 51 with a diameter slightly greater than the diameter of the anchoring element rearward portion 40. The bearing plate 50 has a front surface 52 and a rear surface 53. The bearing plate 50 is adapted to having its central hole 51 slid onto and positioned coincidentally about the anchoring element rearward portion 40 and having the bearing plate front surface 52 abut the anchoring element middle portion flange plate rearward surface 35. The bearing plate front surface 52 has four keys 54 adapted to engaging the anchoring element flange plate keyholes 36. The bearing plate rear surface 53 has a hexagonal sleeve flange 55 about the central hole 51 protruding rearwardly from the bearing plate rear surface 53 a predetermined distance.

The bearing plate sleeve flange 55 and rear surface 53 are adapted to be engaged by a drilling jumbo, i.e., a large drilling machine, (not shown). The anchoring element tip 22 is positioned perpendicular to an excavation face 12 and pointing at the identified point of initiation of advance into the ground 16. The anchoring element 20 is driven into the ground 16 until the bearing plate front surface 52 touches the face 12 of the excavation. The screw part 27 of the anchoring element 20 compacts the surrounding material as it advances. This process is similar to the process of driving a displacement pile into the ground for increasing the load-bearing capacity of the ground. The anchoring element forward portion radial holes 28 provide a means for releasing excess pore water pressure that is developed due to the process of compaction. The drill bit 30 acts as an auger and removes the material through which it is advancing.

The drilling arm of the jumbo is then detached from the bearing plate 50 and is retracted. The invention is further provided with a locking nut 57. See FIG. 3. The locking nut 57 is adapted to engage the anchoring element rearward portion, rearward segment threaded surface 44. The locking nut 57 is attached to the anchoring element rearward segment threaded surface 44 and is tightened against the bearing plate sleeve flange 55 using the drilling arm of the jumbo. The tightening of the nut 57 creates tension in the anchoring element 20, which is made possible by the shear resistance of the contact surface between the tapered anchoring screw 25 and the ground 16. The bearing plate 50 restrains the potential extrusion of the anchored ground 16 and, as a counter reaction, imparts a confining pressure on the face 12.

Figure 5C:
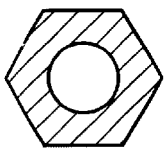
FIG. 5C is a view along the line 93—93 of FIG. 5B.
Figure 5B:
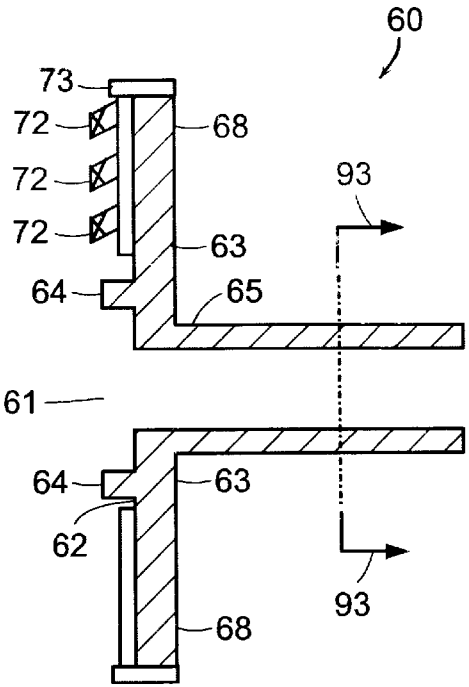
FIG. 5B is a cross-sectional view along the line 92—92 of FIG. 5A.
Figure 5A:
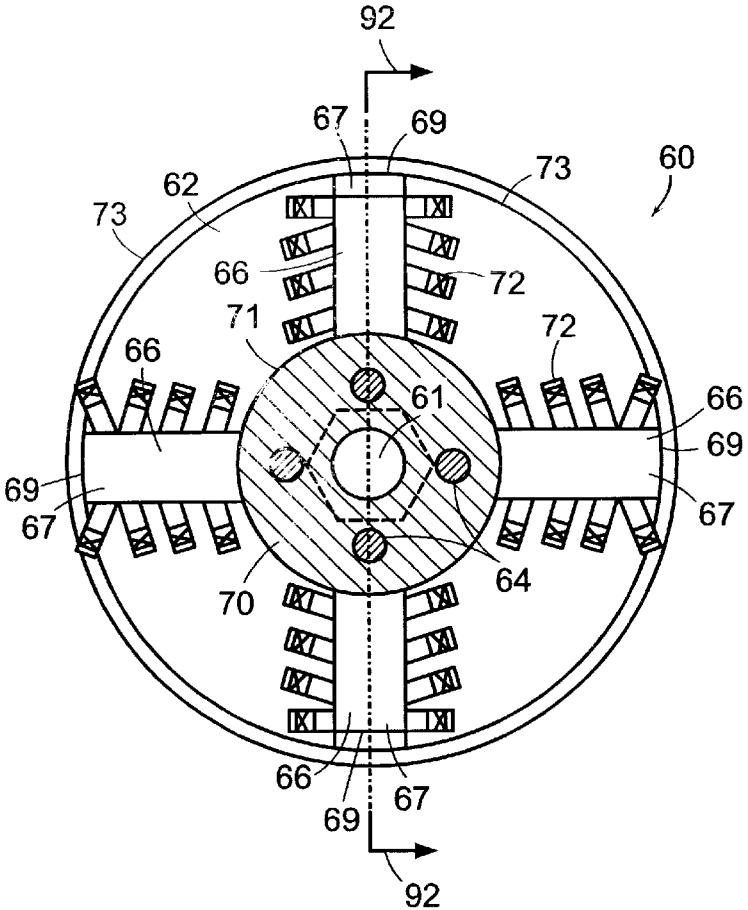
FIG. 5A is an end view the invention excavation head.

Referring more particularly to FIGS. 5*a* and 5*b*, as well as FIGS. 3, 6 and 7, the invention is further comprised of an excavation head 60 attachable to said anchoring element 20. In operation, the excavation head 60 replaces the bearing plate 50. The excavation head 60 and bearing plate 50 are never used at the same time on the same anchoring element 20. The excavation head 60 has a round, torque-transmission plate-like element 70 with a diameter several times greater than the diameter of the anchoring element, middle portion, flange plate 33. The torque plate 70 has a central hole 61 with a diameter slightly greater than the diameter of the anchoring element rearward portion 40. The torque plate 70 has a front surface 62 and a rear surface 63. The torque plate 70 is adapted to having its central hole 61 slid onto and positioned coincidentally about the anchoring element rearward portion 40 and having the torque plate 70 front surface 62 abut the anchoring element middle portion flange plate rearward surface 35. The torque plate 70 front surface 62 has four keys 64 adapted to engaging the anchoring element flange plate keyholes 36. The torque plate 70 rear surface 63 has a hexagonal sleeve flange 65 about the central hole 61 protruding rearwardly from the bearing plate rear surface 63 a predetermined distance.

The torque plate 70 has four excavation arms 66 fixedly attached to its perimeter 71, lying in the same plane as the torque plate 70 and extending radially out from said perimeter 71. Each arm 66 is positioned 90° from each adjacent arm. Each arm 66 has a front surface 67 and a rear surface 68. A plurality of excavation picks 72, i.e., excavation teeth, are attached to the front surface 67 of each arm 66. The number of picks as well as the number of arms are a function of ground conditions. A continuous stiffening ring 73 is attached to the excavation arms' free ends 69, said ring 73 lying in the same plane as the torque plate 70.

In operation, the locking nut 57 is unscrewed using the drilling arm of the jumbo. The bearing plate 50 is detached from the anchoring element 20. The excavation head 60 is then attached to the anchoring element 20 as described above. The excavation head 60 is then activated to excavate material and to simultaneously drive the anchoring element 20 forward. The excavated material, i.e., the muck 17, can be removed from the face 12 by any available technique (such as letting the muck fall to the ground by gravity or by sucking it directly from the excavation head).

Referring more particularly to FIG. 6, there is shown a transitional configuration of the multi-purpose anchor bolts in a tunnel face which otherwise may experience face-stability problems. After advancing to a desired location, a number of anchor bolt assemblies 19 of the present invention are required and are installed in a pre-defined pattern. At a given time, most of these anchor bolts will be performing an anchoring function with bearing plates 50, with only a limited number of the anchor bolt assemblies 19 performing the simultaneous excavation-and-advance function with excavation heads 60. The actual number of the anchor bolt assemblies 19 performing excavation-and-advance functions will depend on the dimension of the face, the type of ground, and the available number of drilling arms. In any case, it will be possible to assure that the influence of the anchor bolt assemblies are performing excavation-and-advance functions is both temporary and localized and, therefore, the overall stability of the face is not be affected. The theoretical excavation boundary is indicated at 80. The theoretical limits of material removed by the excavation head 60 is indicated at 81. The bottom portion 82 of the excavation is normally accomplished by conventional methods, either manual or mechanical.

In general, the components of the present invention are expected to be made of high-strength steel or a steel alloy. However, the surface of the tip 22 and picks 72 will need to be treated with a film of wear-resistant material, such as tungsten carbide or diamond.

The integrated, group effect of the installed invention has several critically important and unique features. The invention provides a high degree of compaction of the ground 16, in and around the face 12, not only helping to preserve the peak strength (the maximum resistance to the applied loads before yielding begins) of the ground, but also increasing it. The mechanical characteristics (strength and deformability) of the ground 16 are also enhanced by the transformation of the ground into a composite material (ground plus the steel bolts). The potential for extrusion of the excavation face 12 is practically eliminated due to the resistance provided by the interaction among the anchor bolts in the group. Under conditions of squeezing (movement of the ground toward the excavated space) and swelling (expansion of the ground after addition of water), it is possible to control the deformation of the face by withdrawing a small, selected number of bolts 19 or, alternatively, by advancing them to a sufficient depth ahead of the face 12. In either case, a cylindrical slot (or slots) is (are) created to allow the surrounding ground to deform radially into the slot(s), thus reducing the amount of supporting pressure that might otherwise be required for stabilizing the periphery of the excavation.

For the very first installation of the anchor bolt assemblies 19 in the excavation face 12, reference is made to the example pattern in FIG. 6. An example sequence of installation of the anchor bolts and excavation of the ground is illustrated in FIG. 7 which is the longitudinal section along the center line of the excavation face 94—94 in FIG. 6, showing a typical application of the invention to tunneling with the order of advancing the anchor bolts established by considering the need of both maintaining a concave face and the ease of muck removal. As shown in FIG. 7, the anchor bolts 19' have temporarily stopped advancing, but are performing their anchoring function. The top anchor bolt 19 is performing simultaneously its excavating-advancing and anchoring function. In order to produce a slightly concave and, therefore, a more stable face, the anchor bolts (b, c, and d) in the central portion of the face are advanced further than the peripheral anchor bolts a and e. This pattern of relative, or offset, advance would be maintained, if required by the nature of the ground. However, to facilitate the removal of muck 17 (or debris) resulting from the excavation, it may be necessary to advance the bottom anchor bolt (e) slightly more than the upper anchor bolt (a). The sequence of advance of the central anchor bolts (b, c, and d) may also follow the rule of starting from the center (c) and progressing outward (to d and b). The excavated boundary (or walls and roof—in the case of a tunnel) will need to be supported by some means after the face has been advanced for a pre-determined "round" length (in conventional excavation) or a "stroke" length (in TBM excavation). The support of the excavated boundary is shown in FIG. 7. The figure indicates that the primary support is provided by a combination of steel ribs 83, sprayed concrete 84, and conventional rock bolts 85. It is noted that the conventional rock bolts can be replaced by the invention (using anchor bolts of a smaller diameter than that required for the face support) through the performance of its anchoring function with the advantages of providing immediate support and reinforcement and support to the excavation boundary and eliminating the need for stabilizing the bolt hole, with a casing, in loose ground, and the need for grouting the hole in all circumstances. As the excavation progresses a permanent concrete lining 86 is formed.

The method of the present invention comprises the following steps. The invention has two principal operations, or functions, which are described below as Functions A and B of the individual, multi-purpose anchor bolts. Function A provides active anchoring of the face of an excavation. Function B involves the excavation-and-advance of the face.

The sequence of operations used for achieving function A is as follows. A drilling jumbo (a large drilling machine) is positioned in front of the excavation face. The bearing plate 50 is coupled with the anchor bolt 20 by inserting the keys 54 into the keyholes 36. The assembly 19 is attached to the drilling arm of the drilling jumbo. The drilling arm is now positioned such that the tip 22 of the anchor bolt 19 is perpendicular to the face 12 and is pointing at the identified point of initiation of advance into the ground 16. The anchor bolt 19 is driven into the ground 16 until the bearing plate face 52 touches the face 12 of the excavation. The screw part 27 of the anchor bolt is compacting the surrounding material as it advances. The side holes 28 in the tapered anchoring screw 25 provide a means for releasing the excess pore water pressure that is developed due to the process of compaction. The drill bit 30 acts as an auger and removes the material through which it is advancing. The drilling arm of the jumbo is detached from the bearing plate 50 and is retracted. The locking nut 57 is attached to the threaded portion 44 of the anchor bolt and is tightened against the bearing plate 55 using the drilling arm of the jumbo. The tightening of the nut 57 creates tension in the anchor bolt 19, which is made possible by the shear resistance of the contact surface between the tapered anchoring screw 20 and the ground 16. The bearing plate 50 restrains the potential extrusion of the anchored ground 16 and, as a counter reaction, imparts a confining pressure on the face 12.

The sequence of operations used for achieving function B is as follows. The locking nut 57 is unscrewed using the drilling arm of the jumbo. The bearing plate 50 is detached from the anchor-bolt assembly 19. The excavation head 60 is attached to the anchor-bolt assembly 19, using the arm of the jumbo, by inserting the keys 64 into the keyholes 36. The excavation head 60 is activated to excavate the material and to simultaneously drive the anchor bolt 19 forward. After advancing to a desired location, the excavation head 60 is removed and the bearing plate 50 is re-attached to the anchor-bolt assembly 19 and is re-tensioned with the locking nut 57. At this point, the invention returns to its anchoring function (Function A).

The integrated, group effect of the installed invention has several critically important and unique features. A high degree of compaction of the ground, in and around the face, is provided not only helping to preserve the peak strength of the ground, but is also increasing it. The mechanical characteristics (strength and deformability) of the ground are also enhanced by the transformation of the ground into a composite material (ground plus the steel bolts). The potential for extrusion of the excavation face is practically eliminated due to the resistance provided by the interaction among the anchor bolts in the group. Under conditions of squeezing (movement of the ground toward the excavated space) and swelling (expansion of the ground after addition of water), it is possible to control the deformation of the face by withdrawing a small, selected number of bolts or, alternatively, by advancing them to a sufficient depth ahead of the face. In either case, a cylindrical slot (or slots) is (are) created to allow the surrounding ground to deform radially into the slot(s), thus reducing the amount of supporting pressure that might otherwise be required for stabilizing the periphery of the excavation. The support of the excavated boundary (or walls and roof—in the case of a tunnel) can be provided by the invention (using anchor bolts of a smaller diameter than that required for the face support) through the performance of its Function A with the advantages of providing immediate support and reinforcement and support to the excavation boundary and eliminating the need for stabilizing the bolt hole, with a casing, in loose ground, and the need for grouting the hole in all circumstances.

Therefore, the main aspects of the invention are to: (a) provide continuous support and reinforcement to the front (or face) of an advancing excavation in weak ground, (b) advance the face at a higher rate compared to the results of the current methods by performing simultaneous reinforcement and excavation, (c) reduce the cost of advancing the excavation by eliminating the need for renewed reinforcement of the face after each advance, (d) improve the reliability of the face reinforcement and, consequently, the safety of the workers, and (d) eliminate the constraint of not exceeding a threshold for the radius of curvature of the tunnel axis, as in the case of excavating by a TBM.

The invention provides an active reinforcement (or stabilizing force) to a part of the excavation face in weak ground. A group of these devices is used to stabilize the entire face whose area may be many times larger than the area of the device. The invention provides both passive and active reinforcement, thus making it possible to control the outward deformation of the face, which is the critical aspect of ground control in design of excavations in weak ground.

It is understood that the above-described embodiment is merely illustrative of the application. Other embodiments may be readily devised by those skilled in the art which will embody the principles of the invention and fall within the spirit and scope thereof.

We claim:

1. A multi-purpose anchor bolt assembly for simultaneous support and excavation of weak ground, comprising:

an elongated, generally cylindrical anchoring element with a variable diameter having a forward end terminating in a conical tip and a rearward end, said forward and rearward ends defining a longitudinal axis, said anchoring element having an internal, central, longitudinal aperture along its central longitudinal axis, said anchoring element being divided longitudinally into three main portions, a forward portion, a middle portion, and a rearward portion;

an excavation head attachable to said anchoring element; and a bearing plate attachable to said anchoring element, wherein said bearing plate is adapted to replace said excavation head.

2. An anchor bolt assembly as recited in claim 1 wherein:

said anchoring element forward portion begins at the anchoring element forward end and extends rearwardly toward the rearward end a predetermined distance, said forward portion comprising a tapered anchoring screw having a diameter increasing from a minimum diameter at the anchoring element forward end to a maximum diameter at the tapered anchoring screw rearmost end;

said anchoring element middle portion extends rearwardly along the anchoring element longitudinal axis from a forward portion rearmost end a predetermined distance toward the anchoring element rearward end, said middle portion comprising a drill bit facilitating the reach of the tapered anchoring screw a desired depth, said middle portion having an external surface shaped with cutting drill teeth, said middle portion terminating rearwardly in a gradually increasing, tapered, radial, flange-like, plate element having a tapered front surface and a flat rear surface, said flange plate front surface facing the anchoring element forward end and said flange plate rear surface facing the anchoring element rearward end, said flange plate rear surface having a plurality of key holes formed therein;

said anchoring element rearward portion extends rearwardly along the anchoring element longitudinal axis from the flange plate rear surface to and terminating at the anchoring element rearward end, said rearward portion comprising a bearing plate and excavation head anchoring element engagement portion, said rearward portion being divided along the anchoring element longitudinal axis into two segments, a forward segment and a rearward segment, said forward segment beginning at said middle portion flange plate rear surface and extending toward the anchoring element rearward end a predetermined distance, said forward segment having a smooth external surface and a diameter less than the diameter of the drill bit, said rearward segment beginning where the forward segment rearwardly ends and extending to the anchoring element rearward end;

wherein the drill bit acts as an auger and removes material through which it is advancing.

3. An anchor bolt assembly as recited in claim 2, wherein:

the bearing plate is a round, plate-like element having a front surface and a rear surface and a diameter greater than the diameter of the anchoring element, middle portion, flange plate, said bearing plate having a central hole with a diameter slightly greater than the diameter of the anchoring element rearward portion, said bearing plate adapted to having its central hole slid onto and positioned coincidentally about the anchoring element rearward portion and having the bearing plate front surface abut the anchoring element middle portion flange plate rearward surface, said bearing plate front surface having a plurality of keys adapted to engaging the anchoring element flange plate keyholes, said bearing plate rear surface having a sleeve flange about the central hole protruding rearwardly from the bearing plate rear surface a predetermined distance;

wherein said bearing plate sleeve flange and rear surface are adapted to be engaged by a drilling machine, said anchoring element tip being positioned perpendicular to an excavation face and pointing at an identified point of initiation of advance into the ground, said anchoring element being driven into the ground until the bearing plate front surface touches the face of the excavation, said anchoring element screw part compacting the surrounding material as it advances.

4. An anchor bolt assembly as recited in claim 3, further comprising:

an anchoring element rearward portion rearward segment threaded external surface and a diameter approximately equal to the diameter of the forward segment;

a locking nut adapted to engage the anchoring element rearward portion, rearward segment threaded surface;

wherein said drilling machine is then detached from the bearing plate and retracted;

wherein the locking nut is attached to the anchoring element rearward segment threaded surface and is tightened against the bearing plate sleeve flange, said tightening of the nut creating tension in the anchoring element, which is made possible by the shear resistance of the contact surface between the tapered anchoring screw and the ground;

wherein said bearing plate restrains potential extrusion of the anchored ground and, as a counter reaction, imparts a confining pressure on the face.

5. An anchor bolt assembly as recited in claim 4, wherein:

the excavation head has a round, torque-transmission, plate-like element having a front surface and a rear surface and a diameter greater than the diameter of the anchoring element, middle portion, flange plate, said torque plate having a central hole with a diameter slightly greater than the diameter of the anchoring element rearward portion, said torque plate adapted to having its central hole slid onto and positioned coincidentally about the anchoring element rearward portion and having the torque plate front surface abut the anchoring element middle portion flange plate rearward surface, said torque plate front surface having a plurality of keys adapted to engage the anchoring element flange plate keyholes, said torque plate rear surface having a sleeve flange about the central hole protruding rearwardly from the bearing plate rear surface a predetermined distance.

6. An anchor bolt assembly as recited in claim 5, wherein:

the torque plate has a plurality of excavation arms fixedly attached to its perimeter, lying in the same plane as the torque plate and extending radially out from said perimeter, each said arm being positioned equidistant from each adjacent arm, each said arm having a front surface and a rear surface, each said front surface having a plurality of excavation picks attached thereto.

7. An anchor bolt assembly as recited in claim 6, wherein:

said excavation head is adapted to replace the bearing plate and activated by the drilling machine to excavate material and to simultaneously drive the anchoring element forward.

8. An anchor bolt assembly as recited in claim 7, wherein said anchoring element forward portion is further comprised of:

a helical external surface suggesting a screw thread;

a plurality of radial holes extending from the external surface and opening into the anchoring element central aperture;

wherein the anchoring element forward portion radial holes are adapted to provide a means for releasing excess pore water pressure developed due to the process of compaction.

9. An anchor bolt assembly as recited in claim 8, wherein:

said flange plate is adapted to providing a means for drilling as well as providing confinement to material expelled by the drill bit.

10. An anchor bolt assembly as recited in claim 9, wherein:

said sleeve flange has a hexagonal cross section.

11. An anchor bolt assembly as recited in claim 10, wherein said torque plate is further comprised of:

a continuous stiffening ring attached to the excavation arms' free ends, said ring lying in the same plane as the torque plate.

12. A method of providing continuous support and reinforcement to a face of an advancing excavation in weak ground with a multi-purpose anchor bolt assembly having a forward end with a tip and a threaded rearward end, said assembly comprised of an elongated anchoring element, a bearing plate attachable to said anchoring element, and an excavation head attachable to said anchoring element, comprising the steps of:

actively anchoring the face of an excavation comprising the steps of:

positioning a drilling machine in front of the excavation face;

coupling the bearing plate with the anchoring element;

attaching the anchor bolt assembly to a drilling arm of the drilling machine;

positioning the drilling arm such that the anchor bolt assembly tip is perpendicular to the face and is pointing at an identified point of initiation of advance into the ground;

driving the anchor bolt assembly into the face until the bearing plate touches the face of the excavation;

detaching the drilling arm from the bearing plate;

attaching a locking nut to the threaded portion of the anchor bolt assembly and tightening said nut against the bearing plate; and advancing an excavation of the face comprising the steps of:

unscrewing and detaching the locking nut;

detaching the bearing plate from the anchor-bolt assembly;

attaching the excavation head to the anchor-bolt assembly;

activating the excavation head to excavate material and to simultaneously drive the anchor bolt assembly forward;

halting the excavation head after advancing to a desired depth;

removing the excavation head;

re-attaching the bearing plate to the anchor-bolt assembly; and re-tensioning the bearing plate with the locking nut.

* * * * *